US005945263A

United States Patent [19]

Deroover et al.

[11] Patent Number: 5,945,263

[45] **Date of Patent: *Aug. 31, 1999**

[54] ANTIHALATION DYE FOR PHOTOTHERMOGRAPHIC RECORDING MATERIAL AND A RECORDING PROCESS THEREFOR

[75] Inventors: Geert Deroover, Kessel-Lo; Etienne Van Thillo, Essen; Ivan Hoogmartens, Wilrijk; Hans Strijckers, Oudergem, all of Belgium

[73] Assignee: Agfa-Gevaert N.V., Mortsel, Belgium

[ * ] Notice: This patent is subject to a terminal disclaimer.

[21] Appl. No.: 08/862,812

[22] Filed: May 30, 1997

[30] Foreign Application Priority Data

Jun. 1, 1996 [EP] European Pat. Off. ..... 96201529

[51] Int. Cl.[6] ..... G03C 1/498; G03C 1/825

[52] U.S. Cl. ..... 430/350; 430/510; 430/517; 430/617; 430/619; 430/944

[58] Field of Search ..... 430/619, 350, 430/944, 517, 510, 617

[56] References Cited

U.S. PATENT DOCUMENTS

| | | | |
|---|---|---|---|
| 4,199,363 | 4/1980 | Chen | 430/512 |
| 5,258,282 | 11/1993 | Kagami et al. | 430/619 |
| 5,322,768 | 6/1994 | Delprato et al. | 430/517 |
| 5,541,235 | 7/1996 | Busman et al. | 522/25 |
| 5,747,412 | 5/1998 | Leenders et al. | 503/201 |

*Primary Examiner*—Thorl Chea
*Attorney, Agent, or Firm*—Baker & Botts, L.L.P.

[57] ABSTRACT

A photothermographic recording material comprising a support; a photo-addressable thermally developable element comprising a substantially light-insensitive organic silver salt, photosensitive silver halide in catalytic association with the substantially light-insensitive organic silver salt spectrally sensitized to the infrared region of the electromagnetic spectrum and a binder; and in a hydrophobic layer an antihalation dye according to the general formula (I):

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, amide-, dialkylamino-, nitro-, cyano-, alkyl-, alkenyl-, aryl-, alkoxy- or aryloxy-group; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring; $R^{12}$, $R^{13}$ and $R^{14}$ independently represent hydrogen, chlorine, bromine or fluorine; and $A^-$ is a fluorinated alkyl or aryl anion in which the degree of fluorination is greater than 70%; a production process therefor and a photothermographic recording process therefor.

8 Claims, No Drawings

ANTIHALATION DYE FOR PHOTOTHERMOGRAPHIC RECORDING MATERIAL AND A RECORDING PROCESS THEREFOR

FIELD OF THE INVENTION

The present invention relates to a photothermographic recording material comprising specific antihalation dyes and a recording process therefor.

BACKGROUND OF THE INVENTION

Thermal imaging or thermography is a recording process wherein images are generated by the use of imagewise modulated thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element containing other of the ingredients necessary for said chemical or physical process followed by uniform heating to bring about said changes in colour or optical density.

3. Thermal dye transfer printing wherein a visible image pattern is formed by transfer of a coloured species from an imagewise heated donor element onto a receptor element.

Thermographic materials of type 1 become photothermographic when a photosensitive agent is present which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over said sheet, and as the image forming component an oxidation-reduction reaction combination which is substantially latent under ambient conditions and which can be initiated into reaction by said free metal to produce a visible change in colour comprising an organic silver salt containing carbon atoms and different from said heavy metal salt as an oxidizing agent and in addition an organic reducing agent containing carbon atoms, said radiation-sensitive heavy metal salt being present in an amount between about 50 and about 1000 parts per million of said oxidation-reduction reaction combination.

Photothermographic recording materials may suffer from a phenomenon known as halation which causes degradation in the quality of the recorded image. A portion of the light, which strikes the photosensitive layer but is not absorbed by it, may be reflected back at the interface between the photo-addressable thermally developable element and the support to strike the photo-addressable thermally developable element from the underside. Light thus reflected may, in some cases, contribute significantly to the total exposure of the photo-addressable thermally developable element. Any particulate matter in this element, for example particles of organic silver salts and silver halide, may cause light passing through it to be scattered. Scattered light which is reflected from the support will, on its second passage through the photo-addressable thermally developable element, cause exposure over an area adjacent to the point of intended exposure leading to image degradation.

In order to improve the sharpness or definition of images obtained with photothermographic materials an antihalation dye is often incorporated into these materials and it may be present in the photo-addressable thermally developable element or in a separate layer. EP-A 627 660 and EP-A 681 213 both disclose an infrared antihalation system for a photothermographic silver halide element that satisfies the requirement of an IR (before exposure)/visible absorbance (after processing) 30:1 can be achieved with non-bleaching dyes with the following general formula:

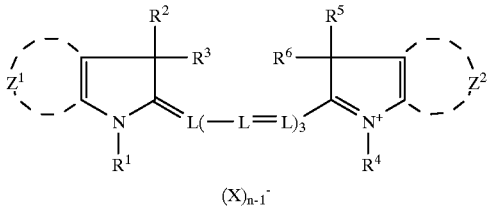

wherein $R^1$, $R^2$, $R^3$, $R^4$, $R^5$ and $R^6$ are the same or different, each represents substituted or unsubstituted alkyl groups; and each of $Z^1$ and $Z^2$ represents a group of non-metallic atoms (e.g. selecterd from C, S, N, O and Se) necessary for the formation of a substituted or unsubstituted benzo-condensed ring or naphtho-condensed ring. Among the groups $R^1$, $R^2$, $R^3$, $R^4$, $R^5$, $R^6$, $Z^1$ and $Z^2$ there may be one or more groups having an acid substituent group (e.g. sulfonic group and carboxylic group) or one or more sulfonamide groups. L represents s substituted or unsubstituted methine group; X represents an anion. Examples of the anion represented by X include halogen ions (such as Cl, Br and I), p-toluenesulfonic acid ion and ethyl sulfate ion. n represents 1 or 2.

U.S. Pat. No. 5,258,282 and JP 04-348 339 discloses indolenine-based pigments according to the general formula given in EP-A 627 660 and EP-A 681 213, but with a wider range of aromatic ring substituents, in association with sensitizing dyes in the heat-developable photosensitive element and in a layer between the heat-developable photosensitive element and the support respectively.

The classes of dye represented by the general formulae disclosed in EP-A 627 660, EP-A 681 213, U.S. Pat. No. 5,258,282 and JP 04-348 339 are not readily incorporated into hydrophobic layers. The incorporation of antihalation dyes in a hydrophobic medium is particularly important for photothermographic materials with photo-addressable thermally developable elements comprising water-soluble and/or water-dispersible binders coated from aqueous media, in order to prevent interfacial mixing between the photo-addressable thermally developable element and an antihalation layer.

OBJECTS OF THE INVENTION

It is therefore a first object of the invention to provide a photothermographic material capable of producing a sharp image with a neutral background colour.

It is therefore a second object of the invention to provide a photothermographic material, comprising a photo-addressable thermally processable element comprising a water-soluble and/or water-dispersible binder, capable of producing a sharp image with a neutral background colour.

It is a further object of the invention to provide a photothermographic recording process utilizing a photothermographic material capable of producing a sharp image with a neutral background colour.

Further objects and advantages of the invention will become apparent from the description hereinafter. SUMMARY OF THE INVENTION According to the present invention, a photothermographic material is provided comprising a support; a photo-addressable thermally developable element comprising a substantially light-insensitive organic silver salt, photosensitive silver halide in catalytic association with the substantially light-insensitive organic silver salt spectrally sensitized to the infrared region of the electromagnetic spectrum and a binder; and in a hydrophobic layer an antihalation dye according to the general formula (I):

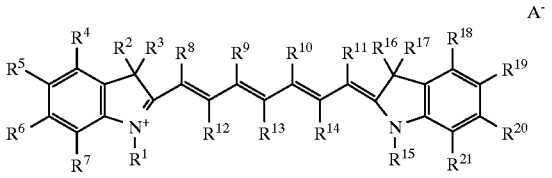

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, amide-, dialkylamino-, nitro-, cyano-, alkyl-, alkenyl-, aryl-, alkoxy- or aryloxy-group; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring; $R^{12}$, $R^{13}$ and $R^{14}$ independently represent hydrogen, chlorine, bromine or fluorine; and $A^-$ is a anion, wherein the anion is a fluorinated alkyl or aryl anion in which the degree of fluorination is greater than 70%.

According to the present invention a process for the production of the photothermographic recording material referred to above is also provided comprising the steps of: (i) loading a polymer latex in an aqueous medium with the antihalation dye by: (I) dissolving the antihalation dye in an organic solvent; (II) adding the antihalation dye solution with stirring to the aqueous medium containing the polymer latex; and (III) evaporating off the organic solvent; and (ii) coating an antihalation layer comprising the antihalation-dye loaded latex and the photo-addressable thermally developable element on the support.

According to the present invention a photothermographic recording process is also provided comprising the steps of: (i) providing the photothermographic recording material referred to above; (ii) image-wise exposing the photothermographic recording material with actinic radiation to which the photothermographic recording material is sensitive; (iii) bringing the image-wise exposed recording material into proximity with a heat source; (iv) thermally developing the image-wise exposed photothermographic recording material; and (v) removing the thermally developed image-wise exposed recording material from the heat source.

Preferred embodiments of the invention are disclosed in the dependent claims.

DETAILED DESCRIPTION OF THE INVENTION

According to the present invention the photothermographic material comprises a support, a photo-addressable thermally developable elemtent and in a hydrophobic layer an antihalation dye according to the general formula I. The hydrophobic layer containing the antihalation layer may be an integral part of the photo-addressable thermally developable element or may be a layer separate from this element, may or may not be adjacent to this element and may be on the same side of the support to this element or on the opposite side of the support to this element.

Antihalation Dyes

The substituent groups of the antihalation dyes of the present invention and the ring structures formed with these substituent groups may also be substituted. Preferred antihalation dyes, according to the present invention, are represented by formula (I) wherein $R^9$ and $R^{10}$ jointly constitute the atoms necessary to complete a a 5-atom or 6-atom carbocyclic ring and $R^{13}$ is chlorine.

According to the present invention $A^-$ is a fluorinated alkyl or aryl anion in which the degree of fluorination is greater than 70%. Such anionic dyes can be prepared as described in EP-A 636 493 and U.S. Pat. No. 4,973,572 and can be loaded onto a polymer latex in an aqueous medium by adding with stirring a solution of the dye in an organic solvent to the polymer latex dispersion and then evaporating off the organic solvent. Such dye-loaded latexes are not only useful for photothermographic recording materials, but may also be used in a wide range of applications including, for example, thermographic applications utilizing image-wise heating with an infra-red heat source in which such dye-loaded latexes can be used to absorb infra-red radiation and convert it into heat or in antihalation layers for such materials and antihalation applications in conventional silver halide emulsion materials.

Particularly suitable antihalation dyes, according to the present invention, are:

DO1:
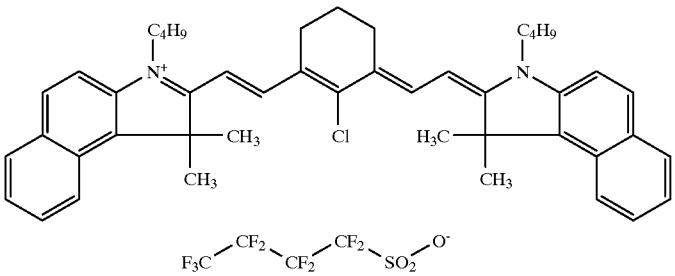
DO2:
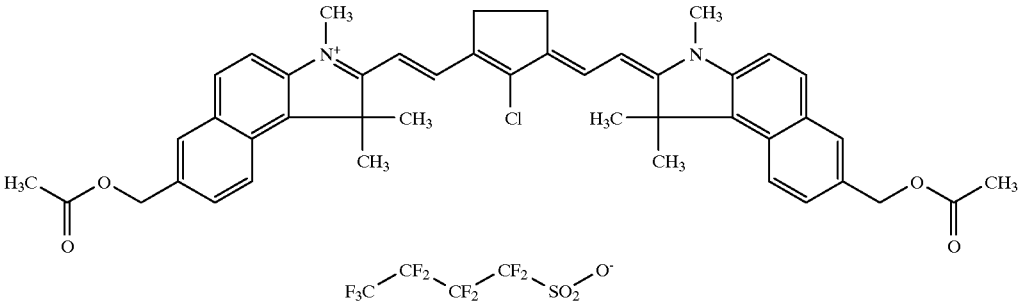
DO3:
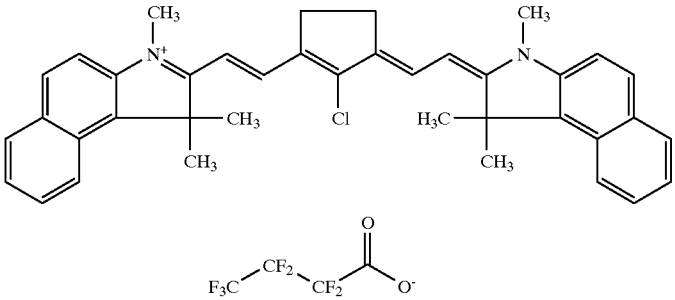
DO4:
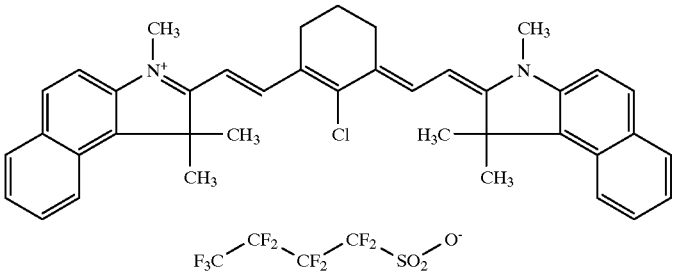
DO5:
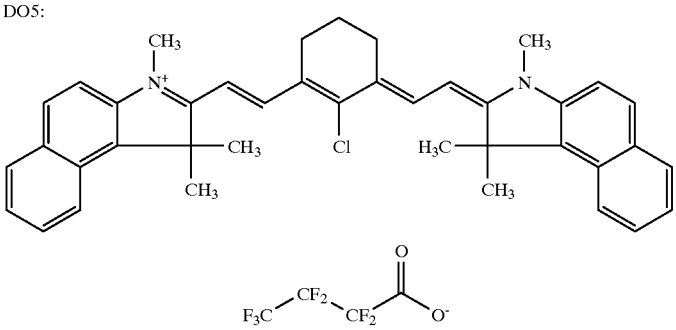
Antihalation dyes, according to the present invention, may be present in a hydrophobic layer. Antihalation dyes, according to the present invention, may also be present in an antihalation layer not comprising part of the photoaddressable thermally developable element. This antihalation layer may be on the opposite side of the support to the photo-addressable thermally developable element.

Photo-addressable Thermally Developable Element

The photo-addressable thermally developable element, according to the present invention, comprises a substantially light-insensitive silver salt of a fatty acid, photosensitive silver halide in catalytic association therewith and an organic reducing agent in thermal working relationship with the substantially light-insensitive silver salt of a fatty acid and a binder. The element may comprise a layer system with the silver halide in catalytic association with the substantially light-insensitive organic silver salt ingredients, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive silver salt of a fatty acid.

Substantially Light-insensitive Organic Silver Salts

Preferred substantially light-insensitive organic silver salts according to the present invention are silver salts of organic carboxylic acids in particular aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Photosensitive Silver Halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of Organic Silver Salt and Photosensitive Silver Halide

A suspension of particles containing a substantially light-insensitive silver salt of an organic carboxylic acid may be obtained by using a process, comprising simultaneous metered addition of an aqueous solution or suspension of an organic carboxylic acid or its salt; and an aqueous solution of a silver salt to an aqueous liquid, as described in EP-A 754 969.

The silver halide may be added to the photo-addressable thermally developable element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

A particularly preferred mode of preparing the emulsion of organic silver salt and photosensitive silver halide for coating of the photo-addressable thermally developable element from solvent media, according to the present invention is that disclosed in U.S. Pat. No. 3,839,049, but other methods such as those described in Research Disclosure, June 1978, item 17029 and U.S. Pat. No. 3,700,458 may also be used for producing the emulsion.

Organic Reducing Agent

Suitable organic reducing agents for the reduction of the substantially light-insensitive organic heavy metal salts are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; 3-pyrazolines; pyrazolones; reducing saccharides; aminophenols e.g. METOL (tradename); p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378.

Among useful aromatic di- and tri-hydroxy compounds having at least two hydroxy groups in para- or ortho-position on the same aromatic nucleus, e.g. benzene nucleus, hydroquinone and hydroquinone derivatives; and catechol and catechol derivatives respectively.

Preferred catechol-type reducing agents, by which is meant reducing agents containing at least one benzene nucleus with two hydroxy groups (—OH) in ortho-position, include 3-(3',4'-dihydroxyphenyl)propionic acid; pyrogallol; gallic acid; gallic acid esters, e.g. methyl gallate, ethyl gallate and propyl gallate; tannic acid; 3,4-dihydroxybenzoic acid esters; and the polyhydroxy-spiro-bis-indane compounds described in U.S. Pat. No. 3,440,049, more especially 3,3,3',3'-tetramethyl-5,6,5',6'-tetrahydroxy-1,1'-spiro-bis-indane and 3,3,3',3'-tetramethyl-4,6,7,4',6',7'-hexahydroxy-1,1'-spiro-bis-indane. Particularly preferred catechol-type reducing agents are described in EP-A 692 733.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

Reducing Agent Incorporation

During the thermal development process the reducing agent must be present in such a way that it is able to diffuse to the substantially light-insensitive organic silver salt particles so that reduction of the organic silver salt can take place.

Molar Ratio of Reducing Agent:Organic Silver Salt

The silver image density depends on the coverage of the above defined reducing agent(s) and organic silver salt(s) and has to be preferably such that, on heating above 80° C., an optical density of at least 1.5 can be obtained. Preferably at least 0.10 moles of reducing agent per mole of organic heavy metal salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols are described in the periodical Research Disclosure, February 1979, item 17842, in U.S. Pat. Nos. 4,360,581 and 4,782,004, and EP-A 423 891. Other auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Spectral Sensitizer

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Binder

The film-forming binder for the photo-addressable thermally developable element according to the present invention may be coatable from a solvent or aqueous dispersion medium.

The film-forming binder for the photo-addressable thermally developable element according to the present invention may be coatable from a solvent dispersion medium, according to the present invention, may be all kinds of natural, modified natural or synthetic resins or mixtures of such resins, wherein the organic silver salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The film-forming binder for the photo-addressable thermally developable element coatable from an aqueous dispersion medium, according to the present invention, may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Weight Ratio of Binder to Organic Silver Salt

The binder to organic heavy metal salt weight ratio is preferably in the range of 0.2 to 6, and the thickness of the photo-addressable thermally developable element is preferably in the range of 5 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the photo-addressable thermally developable element contains preferably in admixture with the organic heavy metal salts and reducing agents a so-called toning agent known from thermography or photothermography.

Suitable toning agents are succinimide, phthalazine and the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione described in GB-P 1,439,478 and U.S. Pat. No. 3,951,660.

A toner compound particularly suited for use in combination with polyhydroxy benzene reducing agents is benzo [e][1,3]oxazine-2,4-dione described in U.S. Pat. No. 3,951, 660.

Stabilizers and Antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Other Additives

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl or static.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders cellulose acetate butyrate, polymethylmethacrylate and polycarbonates, as described, for example, in EP-A 614 769, are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer of the photothermographic recording material, according to the present invention, may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic Layer

A photothermographic recording material, according to the present invention, may have an antistatic layer to prevent charging of the material due to triboelectric contact during coating, transport during finishing and packaging and transport in an apparatus for image-wise exposure and thermal development.

In a preferred embodiment of the photothermographic recording material of the present invention an antistatic layer is applied to the opposite side of the support to the photoaddressable thermally developable element. Suitable antistatic layers therefor are described in EP-A's 444 326, 534 006 and 644 456, U.S. Pat. Nos. 5,364,752 and 5,472,832 and DOS 4125758. Particularly preferred antistatic layers are disclosed in EP-A 628 560, U.S. Pat. No. 5,312,681, U.S. Pat. No. 5,354,613, U.S. Pat. No. 5,372,924, U.S. Pat. No. 5,370,981 and U.S. Pat. No. 5,391,472.

In a particularly preferred embodiment of the present invention, an antihalation dye, according to the present invention, is incorporated into the antistatic layer.

Coating

The coating of any layer of the photothermographic recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Photothermographic Recording Process

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the appending claims.

The following ingredients in addition to those mentioned above were used in the photothermographic recording materials of the invention examples and comparative examples: antihalation dyes according to EP-A 627 660:

CDO1:

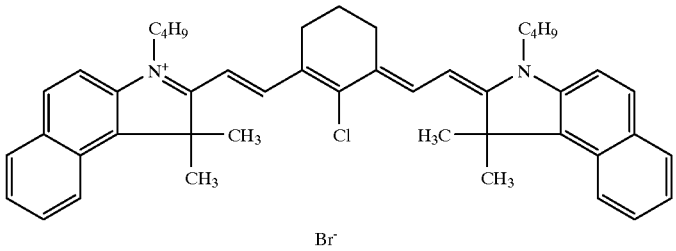

-continued

CD02:

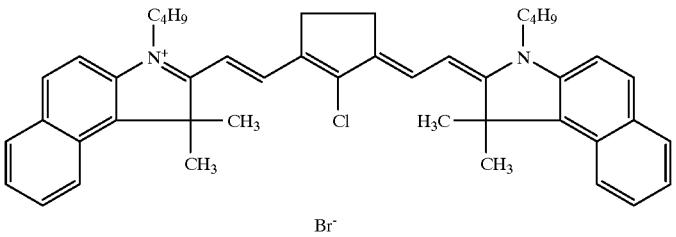

antistatic layer ingredients:

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a dispersion of poly(3,4-ethylenedioxy-thiophene)/polystyrene sulphonic acid produced by the polymerization of 3,4-ethylenedioxy-thiophene in the presence of polystyrene sulphonic acid and ferric sulphate as described in U.S. Pat. No. 5,354,613;

ULTRAVON™ W: an aryl sulfonate from CIBA-GEIGY;

PERAPRE™ PE40: a 40% aqueous dispersion of polyethylene wax from BASF;

KIESELSOL™ 100F: a 36% aqueous dispersion of colloidal silica from BAYER;

MAT01: 20% aqueous dispersion of particles of crosslinked methylmethacrylate(98% by weight)-stearylmethacrylate(2% by weight)-copolymeric beads with an average particle size of 5.9 μm produced as described in U.S. Pat. No. 4,861,812;

LATEX01: a 12% by weight dispersion of polymethyl methacrylate with an average particle size of 88.8 nm prepared as described in U.S. Pat. No. 5,354,613;

photo-addressable thermally developable element ingredients:

i) silver behenate/silver halide emulsion layer:

GEL: phthaloylgelatin, type 16875 from ROUSSELOT;

Butvar™ B76: polyvinylbutyral from MONSANTO;

LOWINOX™ 22IB46: 2-propyl-bis(2-hydroxy-3,5-dimethylphenyl)methane from CHEM. WERKE LOWI;

PHP: pyridinium hydrobromide perbromide;

CBBA: 2-(4-chlorobenzoyl)benzoic acid;

TMPS: tribromomethyl benzenesulfinate;

MBI: 2-mercaptobenzimidazole;

SENSI:

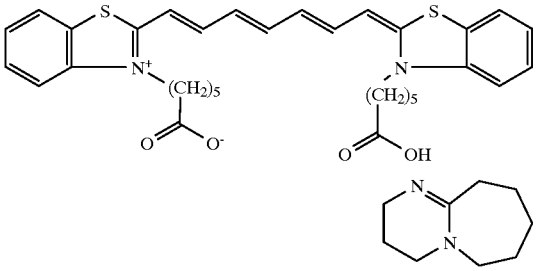

ii) protective layer:

CAB: cellulose acetate butyrate, CAB-171-15S from EASTMAN;

PMMA: polymethylmethacrylate, Acryloid™ K120N from ROHM & HAAS.

The invention is illustrated hereinafter by way of invention examples and comparative examples. The percentages given in these examples are by weight unless otherwise indicated.

INVENTION EXAMPLES

Antihalation Dyes in Hydrophobic Layers

In INVENTION EXAMPLES 1 to 5 antihalation dyes D01 to D05, according to the present invention, were coated in a layer of LATEX01 onto a polyethylene terephthalate support. The dyes were first dissolved in ethyl acetate, the resulting ethyl acetate solutions were then added to LATEX01 and finally the latex was coated onto a 76 μm thick polyethylene terephthalate support.

The transmission spectra of the layers of INVENTION EXAMPLES 1 to 5 were spectrophotometrically evaluated using a DIANO™ MATCHSCAN spectrophotometer tpo obtain the absorption maxima in the infrared region of the spectrum, $\lambda_{max}$, the absorptances of the layers at $\lambda_{max}$, $D_{max}$, and the absorptances at 830 nm, $D_{830}$. The values were measured as the infrared material for which the antihalation dyes were being evaluated was intended of use with a 830 nm light source.

TABLE 1

| Antihalodye | Invention example number | PMMA coverage mg/m² | AH-dye coverage mg/m² | $\lambda_{max}$ [nm] | $D_{max}$ | $D_{830}$ |
|---|---|---|---|---|---|---|
| D02 | 1 | 250 | 11 | 822 | 0.092 | 0.082 |
| D03 | 2 | 200 | 11 | 881 | 0.095 | |
| D04 | 3 | 200 | 11 | 822 | 0.055 | 0.049 |
| D05 | 4 | 200 | 11 | 750 | 0.072 | 0.038 |

The results shown in Table 1 demonstrate the suitability of dyes according to the present invention for use as antihalation dyes in hydrophobic layers.

Invention Examples 5 to 9 and Comparative Example 1

Support

A polyethyleneterephthalate (PET) foil was first coated on both sides with a subbing layer consisting of a terpolymer latex of vinylidene chloride-methyl acrylate-itaconic acid (88/10/2) in admixture with colloidal silica (surface area 100 m²/g). After stretching the foil in the transverse direction the foil had a thickness of 175 μm with coverages of the terpolymer and of the silica in the subbing layers of 170 mg/m² and 40 mg/m² respectively on each side of the PET-foil.

Antihalation/antistatic Layer

The antihalation/antistatic layers of the photothermographic recording materials of invention examples 5 to 9 were prepared by first adsorbing antihalation dye D01 onto the polymethyl methacrylate particles of LATEX01 by adding different quantities of D01 dissolved in ethyl acetate/g polymethyl methacrylate and then evaporating off the ethyl acetate:

Comparative example 1: no D01 adsorbed on LATEX01

Invention example 5: 0.035 g of D01 for a coating weight of 7 mg/m$^2$

Invention example 6: 0.045 g of D01 for a coating weight of 9 mg/m$^2$

Invention example 7: 0.055 g of D01 for a coating weight of 11 mg/m$^2$

Invention example 8: 0.065 g of D01 for a coating weight of 13 mg/m$^2$

Invention example 9: 0.100 g of D01 for a coating weight of 2 mg/m$^2$

One side of the thus subbed PET-foil was then coated with an antistatic composition consisting obtained by dissolving 0.30 g of KELZAN™ S in a stirred mixture of 22.4 mL of N-methylpyrrolidone, 0.84 g of ULTRAVON™ W, 1 g of PERAPRET™ PE40 and 2.22 g of KIESELSOL 100F in 74.3 mL of deionized water and then adding with stirring: 0.2 mL of $NH_4OH$, 0.6 g of dried PT-dispersion, 66.7 mL of LATEX01 after adsorption of D01, 1.2 mL of MAT01 and 30 mL of 2-propanol to produce a layer after drying at 120° C. consisting of:

| | |
|---|---|
| KELZAN ™ S: | 7.5 mg/m$^2$ |
| Dried PT-dispersion: | 15 mg/m$^2$ |
| ULTRAVON ™ W: | 21 mg/m$^2$ |
| polyethylene wax (from PERAPRET ™ PE40): | 10 mg/m$^2$ |
| colloidal silica (from KIESELSOL ™ 100F): | 20 mg/m$^2$ |
| 5.9 μm beads of crosslinked methylmethacrylate-stearylmethacrylate copolymer (from MAT01): | 6 mg/m$^2$ |
| polymethylmethacrylate (from LATEX01): | 200 mg/m$^2$ |
| Antihalation dye D01: | 0 to 20 mg/m$^2$ |

The transmission absorption spectra of the antihalation/antistatic layers of the photothermographic recording materials of invention examples 5 to 9, with the D01 coating weights given in table 2, were spectrophotometrically evaluated using a DIANO™ MATCHSCAN spectrophotometer to obtain the absorption maxima in the infrared region of the spectrum, $\lambda_{max}$, and the absorptances at 830 nm, $D_{830}$. The values $D_{830}$ were measured as the infrared material with which the antihalation dyes were being used had a maximum spectral sensitivity at about 830 nm.

TABLE 2

| Invention example number | Coating weight of D01 [mg/m$^2$] | $\lambda_{max}$ [nm] | $D_{830}$ |
|---|---|---|---|
| 5 | 7 | 835 | 0.13 |
| 6 | 9 | 835 | 0.19 |
| 7 | 11 | 835 | 0.23 |
| 8 | 13 | 835 | 0.27 |
| 9 | 20 | 835 | 0.40 |

Silver Halide Emulsion

A silver halide emulsion consisting of 3.11% by weight of silver halide particles consisting of 97 mol % silver bromide and 3 mol % silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver Behenate/silver Halide Emulsion

The silver behenate/silver halide emulsion was prepared by adding a solution of 6.8 kg of behenic acid in 67 L of 2-propanol at 65° C. to a 400 L vessel heated to maintain the temperature of the contents at 65° C., converting 96% of the behenic acid to sodium behenate by adding with stirring 76.8 L of 0.25M sodium hydroxide in deionized water, then adding with stirring 10.5 kg of the above-described silver halide emulsion at 40° C. and finally adding with stirring 48 L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

8.97 g of the dried powder containing 9 mol % silver halide and 2.4 mol % behenic acid with respect to silver behenate were then dispersed in a solution of 9.15 g of Butvar™ B76 in 38.39 g of 2-butanone using conventional dispersion techniques yielding a 32% by weight dispersion. A solution of 3.31 g of Butvar™ B76 in 28.33 g of 2-butanone was then added yielding a 24.3% by weight dispersion.

Coating and Drying of Silver Behenate/silver Halide Emulsion Layer

An emulsion layer coating composition for the photothermographic recording materials of invention examples 5 to 9 and comparative example 1 was prepared by adding the following solutions or liquids to 88.15 g of the above-mentioned silver behenate/silver halide emulsion in the following sequence with stirring: 0.8 g of a 11.5% solution of PHP in methanol followed by a 2 hours stirring, 1 g of 2-butanone, 0.2 g of a 11% solution of calcium bromide in methanol and 1 g of 2-butanone followed by 30 minutes stirring, 0.6 g of CBBA, 1.33 g of a 0.2% solution of SENSI in 99:1 methanol:triethylamine and 0.04 g of MBI followed by 15 minutes stirring, 2.78 g of LOWINOX™ 22IB46 and finally 0.5 g of TMPS followed by 15 minutes stirring.

The PET-foil subbed and coated with an antistatic layer as described above was then doctor blade-coated at a blade setting of 150 μm on the side of the foil not coated with an antistatic layer with the coating composition to a wet layer thickness of 104 μm, which after drying for 5 minutes at 80° C. on an aluminium plate in a drying cupboard produced a layer with the following composition:

| | |
|---|---|
| Butvar ™ B76 | 12.49 g/m$^2$ |
| GEL | 0.045 g/m$^2$ |
| $AgBr_{0.97}I_{0.03}$ | 0.301 g/m$^2$ |
| behenic acid | 0.145 g/m$^2$ |
| silver behenate | 7.929 g/m$^2$ |
| PHP | 0.092 g/m$^2$ |
| calcium bromide | 0.022 /m$^2$ |
| LOWINOX ™ 22IB46 | 2.78 /m$^2$ |
| CBBA | 0.600 g/m$^2$ |
| SENSI | 0.00266 g/m$^2$ |
| MBI | 0.04 g/m$^2$ |
| TMPS | 0.500 g/m$^2$ |

Protective Layer

A protective layer coating compositions for the photothermographic recording materials of invention examples 5 to 9 and comparative example 1 were prepared by dissolving 4.08 g of CAB and 0.16 g of PMMA in 56.06 g of 2-butanone and 5.2 g of methanol adding the following solids with stirring in the following sequence: 0.5 g of phthalazine, 0.2 g of 4-methylphthalic acid, 0.1 g of tetrachlorophthalic acid, 0.2 g of tetrachlorophthalic acid anhydride.

The emulsion layer was then doctor blade-coated at a blade setting of 100 μm with the protective layer coating composition to a wet layer thickness of 70 μm, which after drying for 8 minutes at 80° C. on an aluminium plate in a drying cupboard produced a layer with the following composition:

| | |
|---|---|
| CAB | 4.08 g/m$^2$ |
| PMMA | 0.16 g/m$^2$ |
| Phthalazine | 0.50 g/m$^2$ |
| 4-methylphthalic acid | 0.20 g/m$^2$ |
| tetrachlorophthalic acid | 0.10 g/m$^2$ |
| tetrachlorophthalic acid anhydride | 0.20 g/m$^2$ |

Image-wise Exposure and Thermal Processing

The photothermographic recording materials of invention example 9 and comparative example 1 were exposed to a 849 nm single mode diode laser beam from SPECTRA DIODE LABS with a nominal power of 100 mW of which 50 mW actually reaches the recording material focussed to give a spot diameter (1/e$^2$) of 28 μm, scanned at speed of 50 m/s with a pitch of 14 μm through a wedge filter with optical density varying between 0 and 3.0 in optical density steps of 0.15.

Thermal processing was carried out for 10 s on a drum heated to a temperature of 119° C. and the $D_{max}$- and $D_{min}$-values of the resulting wedge images were evaluated with a MACBETH™ TD904 densitometer with an ortho filter to produce a sensitometric curve for the photothermographic material and the image sharpness was assessed qualitatively using the following numerical codes:

0=unacceptable image sharpness

1=poor image sharpness

2=acceptable image sharpness

3=good image sharpness

The results of the image characteristic evaluation for the photothermographic recording materials of comparative example 1 and invention example 9 are summarized in table 3.

TABLE 3

| | Coating weight of D01 [mg/m$^2$] | image characteristics $D_{max}$ | $D_{min}$ | Image sharpness |
|---|---|---|---|---|
| Comparative example number | | | | |
| 1 | 0 | 3.65 | 0.21 | 0 |
| Invention example number | | | | |
| 9 | 20 | 4.00 | 0.20 | 3 |

From these results it is clear that the incorporation of 20 mg/m$^2$ of D01 in the antihalation/antistatic layer enables an image with a good image sharpness to be obtained, whereas the non-use thereof produces an image with unacceptable image sharpness.

Invention Examples 10 and 11

The protective layers of invention examples 10 and 11 were produced as described for invention examples 5 to 9, but with 10 mg/m$^2$ and 15 mg/m$^2$ of D01 respectively with separate coating on a 170 μm thick polyethylene terephthalate support.

The transmission absorption spectra of the protective layers of invention examples 10 and 11 were spectrophotometrically evaluated using a DIANO™ MATCHSCAN spectrophotometer to obtain the absorption maxima in the infrared region of the spectrum, $\lambda_{max}$, and the absorptances at 830 nm, $D_{830}$. The values $D_{830}$ were measured as the infrared material with which the antihalation dyes were being used had a maximum spectral sensitivity at about 830 nm.

TABLE 4

| Invention example number | Coating weight of D01 [mg/m$^2$] | $\lambda_{max}$ [nm] | $D_{830}$ |
|---|---|---|---|
| 10 | 10 | 829 | 0.13 |
| 11 | 15 | 829 | 0.25 |

Comparative Examples 2 and 3

The procedure described in INVENTION EXAMPLES 5 to 9 for the preparation of antihalation/antistatic layers was then repeated with the antihalation dyes CD01 and CD02 according to the general formula given in EP-A 627 660. However, these dyes exhibited insufficient solubility in organic solvents to enable adsorption onto the polymethylmethacrylate latex to take place and therefore no satisfactory antihalation/antistaic layer could be coated with these dyes. This demonstrates the higher hydrophobicity of dyes according to the present invention compared with dyes according to the state of the art as exemplified by EP-A 627 660.

Having described in detail preferred embodiments of the current invention, it will now be apparent to those skilled in the art that numerous modifications can be made therein without departing from the scope of the invention as defined in the following claims.

We claim:

1. A photothermographic recording material comprising on a support a photo-addressable thermally developable element comprising a substantially light-insensitive organic silver salt, photosensitive silver halide in catalytic association with said substantially light-insensitive organic silver salt spectrally sensitized to the infrared region of the electromagnetic spectrum and a binder; and in a hydrophobic layer on the opposite side of said support to said photo-addressable thermally developable element an antihalation dye according to the formula (I):

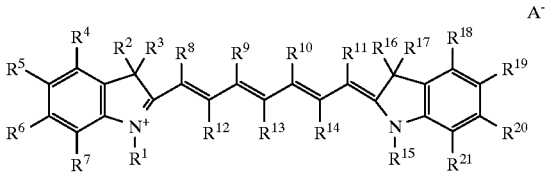

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, amide-, dialkylamino-, nitro-, cyano-, alkyl-, alkenyl-, aryl-, alkoxy- or aryloxy-group; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring; $R^{12}$, $R^{13}$ and $R^{14}$ independently represent hydrogen, chlorine, bromine or fluorine; and an anion $A^-$, wherein said anion is a fluorinated alkyl or aryl anion in which the degree of fluorination is greater than 70%.

2. Photothermographic recording material according to claim 1, wherein said binder comprises a water-soluble binder, a water-dispersible binder or a mixture of a water-soluble and a water-dispersible binder.

3. Photothermographic recording material according to claim 1, wherein said antihalation dye is represented by formula (I) wherein $R^9$ and $R^{10}$ jointly constitute the atoms necessary to complete a 5-atom or 6-atom carbocyclic ring and $R^{13}$ is chlorine.

4. Photothermographic recording material according to claim 1, wherein said antihalation layer is a layer on the same side of said support as said photo-addressable thermally developable element.

5. Photothermographic recording material according to claim 1, wherein said substantially light-insensitive organic silver salt is a silver salt of an aliphatic carboxylic acid.

6. Photothermographic recording material according to claim 1, wherein said photo-addressable thermally developable element is provided with a protective layer.

7. A process for the production of a photothermographic recording material comprising on a support a photo-addressable thermally developable element comprising a substantially light-insensitive organic silver salt, photosensitive silver halide in catalytic association with said substantially light-insensitive organic silver salt spectrally sensitized to the infrared region of the electromagnetic spectrum and a binder; and in a hydrophobic layer an antihalation dye according to the formula (I):

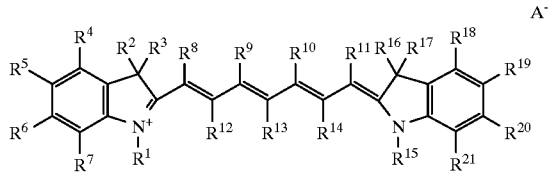

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, amide-, dialkylamino-, nitro-, cyano-, alkyl-, alkenyl-, aryl-, alkoxy- or aryloxy-group; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring; $R^{12}$, $R^{13}$ and $R^{14}$ independently represent hydrogen, chlorine, bromine or fluorine; and an anion $A^-$; comprising the steps of: (i) loading a polymer latex in an aqueous medium with said antihalation dye by: (I) dissolving said antihalation dye in an organic solvent; (II) adding said antihalation dye solution with stirring to said aqueous medium containing said polymer latex; and (III) evaporating off said organic solvent; and (ii) coating an antihalation layer comprising said antihalation dye-loaded latex and said photo-addressable thermally developable element on said support, wherein said anion is a fluorinated alkyl or aryl anion in which the degree of fluorination is greater than 70%.

8. A photothermographic recording process comprising the steps of: (i) providing a photothermographic recording material comprising on a support a photo-addressable thermally developable element comprising a substantially light-insensitive organic silver salt, photosensitive silver halide in catalytic association with said substantially light-insensitive organic silver salt spectrally sensitized to the infrared region of the electromagnetic spectrum and a binder; and in a hydrophobic layer on the opposite side of said support to said photo-addressable thermally developable element an antihalation dye according to the formula (I):

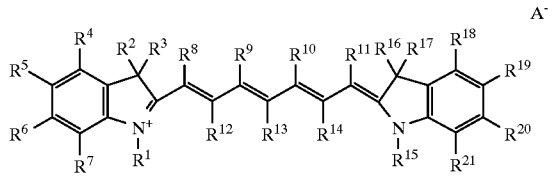

wherein $R^1$ and $R^{15}$ independently represent an alkyl group or an alkyl group substituted with at least one fluorine, chlorine, bromine or an alkoxy-, aryloxy- or ester-group; $R^2$, $R^3$, $R^{16}$ and $R^{17}$ independently represent an alkyl group; $R^4$, $R^5$, $R^6$, $R^7$, $R^{18}$, $R^{19}$, $R^{20}$ and $R^{21}$ independently represent hydrogen, chlorine, bromine, fluorine or a keto-, sulfo-, carboxy-, ester-, sulfonamide-, amide-, dialkylamino-, nitro-, cyano-, alkyl-, alkenyl-, aryl-, alkoxy- or aryloxy-group; or each of $R^4$ together with $R^5$, $R^5$ together with $R^6$, $R^6$ together with $R^7$, $R^{18}$ together with $R^{19}$, $R^{19}$ together with $R^{20}$ or $R^{20}$ together with $R^{21}$ may independently constitute the atoms necessary to complete a benzene ring; $R^8$, $R^9$, $R^{10}$ and $R^{11}$ independently represent hydrogen, an alkyl group or each of $R^1$ together with $R^8$, $R^8$ together with $R^9$, $R^9$ together with $R^{10}$, $R^{10}$ together with $R^{11}$ or $R^{11}$ together with $R^{15}$ may independently constitute the atoms necessary to complete a 5-atom or 6-atom carbocylic or heterocyclic ring; $R^{12}$, $R^{13}$ and $R^{14}$ independently represent hydrogen, chlorine, bromine or fluorine; and an anion $A^-$; (ii) image-wise exposing said photothermographic recording material with actinic radiation to which said photothermographic recording material is sensitive; (iii) bringing said image-wise exposed recording material into proximity with a heat source; (iv) thermally developing said image-wise exposed photothermographic recording material; and (v) removing said thermally developed image-wise exposed recording material from said heat source, wherein said anion is a fluorinated alkyl or aryl anion in which the degree of fluorination is greater than 70%.

* * * * *